United States Patent [19]

Yasunaga et al.

[11] 4,204,297

[45] May 27, 1980

[54] VACUUM CLEANER

[76] Inventors: Ryuichi Yasunaga, 250-10, Tatebe Sakai-cho, Yohkaichi-shi, Shiga-ken; Shinya Tsutsumi, 1863-10, Wakaba-cho, 5-chome, Ohmi-hachiman-shi, Shiga-ken; Mototsugu Kuroda, 205, Tsukamoto, Gokasyo-cho, Kanzaki-gun, Shiga-ken, all of Japan

[21] Appl. No.: 2,351

[22] Filed: Jan. 10, 1979

[30] Foreign Application Priority Data

Jan. 19, 1978 [JP] Japan ..... 53-005508[U]
Jan. 19, 1978 [JP] Japan ..... 53-005510[U]

[51] Int. Cl.[2] ..... A47L 5/36; A47L 9/26
[52] U.S. Cl. ..... 15/323; 15/377
[58] Field of Search ..... 15/377, 323; 174/47

[56] References Cited

U.S. PATENT DOCUMENTS

| | | | |
|---|---|---|---|
| 2,266,075 | 12/1941 | Replogle | 15/377 X |
| 3,614,705 | 10/1971 | Descarries | 15/377 X |
| 3,815,170 | 6/1974 | Brooks et al. | 15/377 X |
| 3,961,647 | 6/1976 | Doubleday | 174/47 X |
| 4,052,767 | 10/1977 | Dutcher | 15/377 |

*Primary Examiner*—Christopher K. Moore
*Attorney, Agent, or Firm*—Joseph W. Farley

[57] ABSTRACT

A vacuum cleaner comprising a main body incorporating an electric fan and a dust collector, a nozzle having a motor-driven rotary brush therein, a flexible hose having one end connected to the main body, a bent pipe connected to the other end of the flexible hose, and an extension pipe connecting the bent pipe to the nozzle. An electrical cord extending from the nozzle and connected to the other end of the flexible hose is tensioned to extend along the extension pipe and the bent pipe and partly covered with a cord cover over the portion thereof coextensive with the bent pipe. The cord will not interfere with the movement of the nozzle, assuring an easy cleaning operation.

7 Claims, 14 Drawing Figures

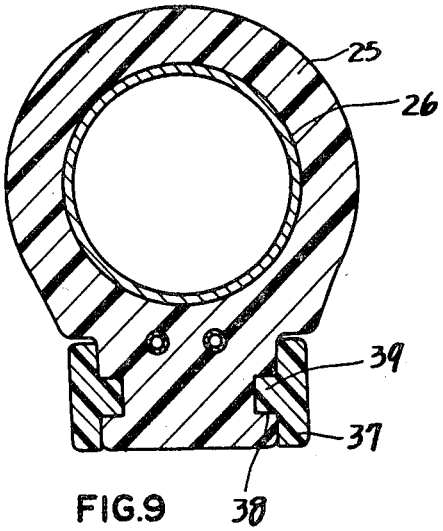
FIG.9
FIG.10
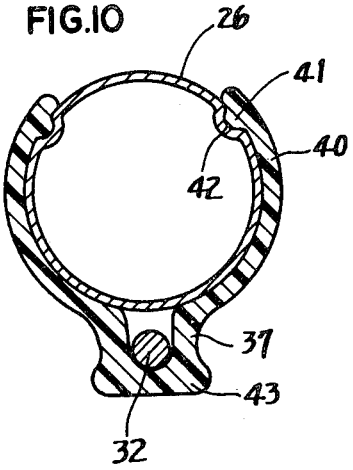
FIG.11
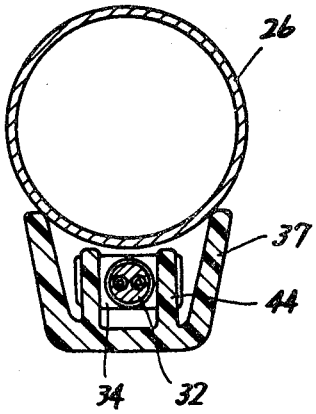
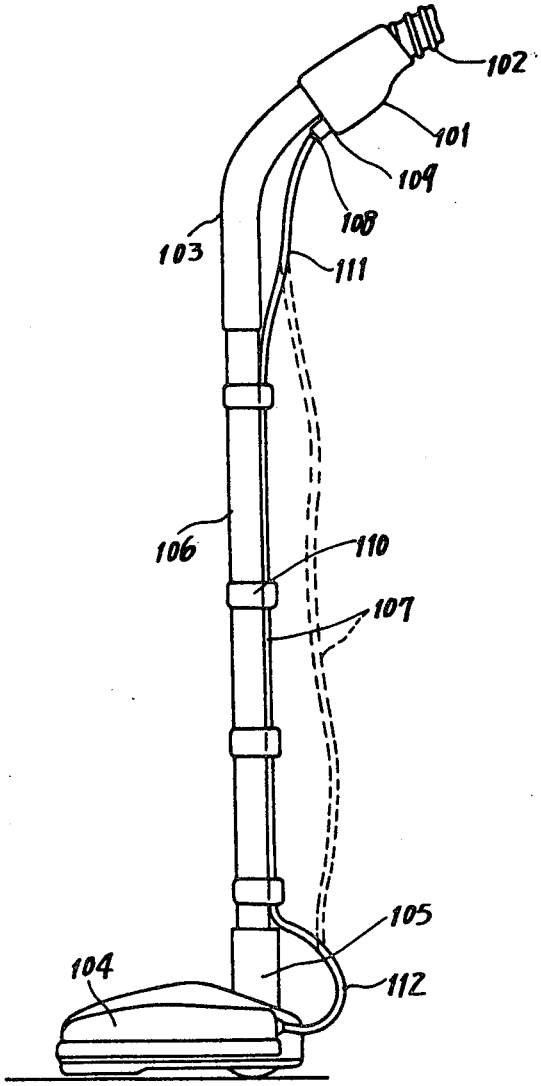
FIG.14

VACUUM CLEANER

The present invention relates to a vacuum cleaner including pipes and a flexible hose for connecting a nozzle incorporating a motor-driven rotary brush to the cleaner main body having a dust collector on the suction side of an electric fan, and more particularly to improvements in guide means for the cord electrically connecting the nozzle to the cleaner main body.

FIG. 14 shows a vacuum cleaner of this type heretofore known in which a bent pipe 103 connected by a connector 101 to a flexible hose 102 is held by an extension pipe 106 in communication with a connecting pipe 105 mounted on a nozzle 104 turnably about a horizontal axis. An electrical cord 107 extending from the nozzle 104 along the pipe 106 has at its forward end a plug 108 fitted in a socket 109 in the connector 101. The socket 109 is electrically connected to the cleaner main body through a lead wire embedded in the flexible hose 102.

The bent pipe 103 is provided to render the nozzle 104 easily usable. Similarly the turnable connecting pipe 105 is mounted on the nozzle 104 to facilitate the cleaning operation.

The cord 107 is allowed to freely extend as illustrated in dotted lines or, as shown in solid lines, held to the pipe 106 by holders 110. In the former case, the cord will be caught as by furniture, whereas even when held to the pipe 106, the cord still involves the problem that slack portions 111 and 112 of the cord will be caught by furniture or like article.

The slack portion 111 serves to prevent the disengagement of the plug 108 from the socket 109, while the other slack portion 112 is provided for the turn of the connecting pipe 105.

Thus the conventional cleaner is not smoothly usable owing to the provision of the cord 107. Further when the bent pipe 103 is held with the hand for operation, the hand will touch the plug 108, inadvertently disengaging the plug 108 from the socket 109.

The main object of this invention is to prevent the above-mentioned cord from interfering with the operation of the cleaner.

To fulfil this object, the electrical cord used in the cleaner of this invention is tensioned as by the action of a spring and is partially provided with a cord cover over the portion thereof coextensive with a bent pipe.

According to a preferred embodiment of this invention, the cord cover is freely turnable to render the plug easily fittable into or detachable from the socket.

According to another preferred embodiment of this invention, the cord cover is provided with a stopper for preventing the plug from inadvertently slipping off the socket under the tension of the cord.

According to another preferred embodiment of this invention, the cord is tensioned by the take-up force of a cord reel provided in the nozzle of the cleaner.

Embodiments of the invention will be described below with reference to the accompanying drawings, in which:

FIG. 9 is a view in section taken along the line IX—IX in FIG. 8;

FIG. 10 is a view in section taken along the line X—X in FIG. 8;

FIG. 11 is a view in section taken along the line XI—XI in FIG. 8;

FIG. 14 is an overall side elevation showing a conventional vacuum cleaner.

Figure 1:
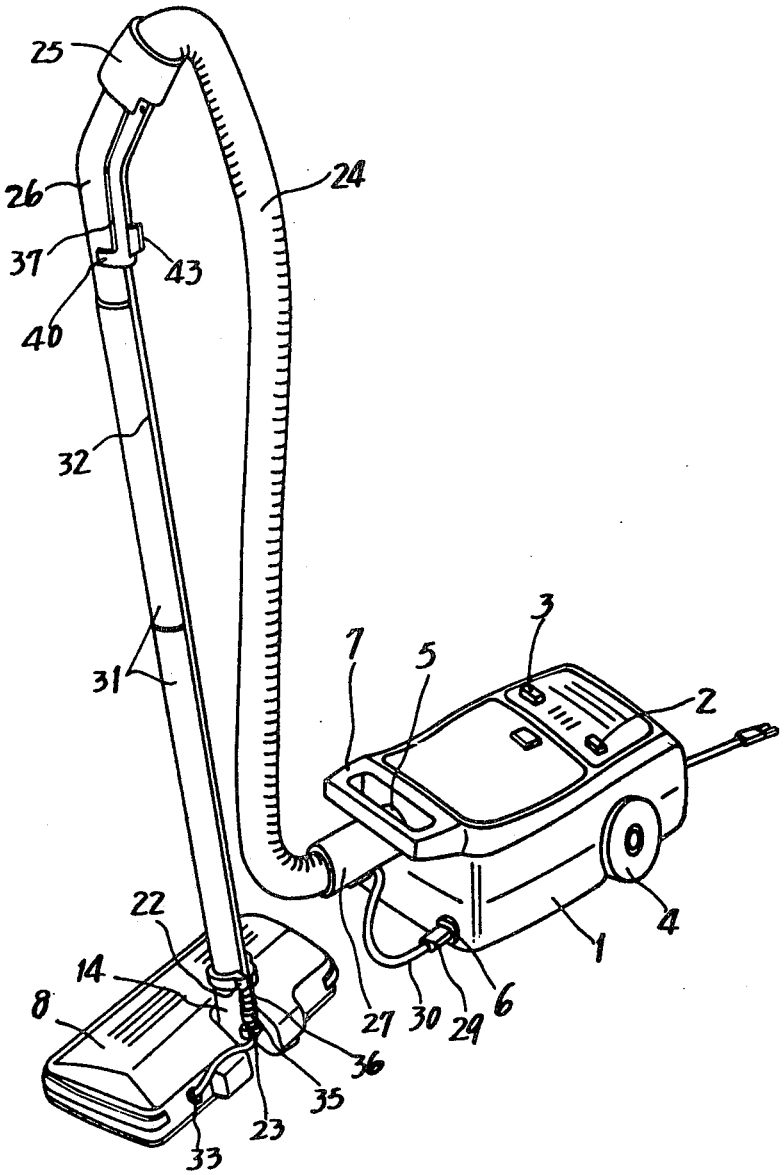
FIG. 1 is a perspective view showing a vacuum cleaner in its entirety.

With reference to FIGS. 1 to 11, indicated at 1 is a cleaner main body incorporating an electric fan, a dust collector bag, cord reel, etc. and having a switch pedal 2 for actuating an operation switch, a pedal 3 for the cord reel on its top, wheels 4 at its lower portion, and a suction opening 5 and a socket 6 on the front side thereof. Designated at 7 is a handle for carrying the cleaner main body 1.

Figure 2:
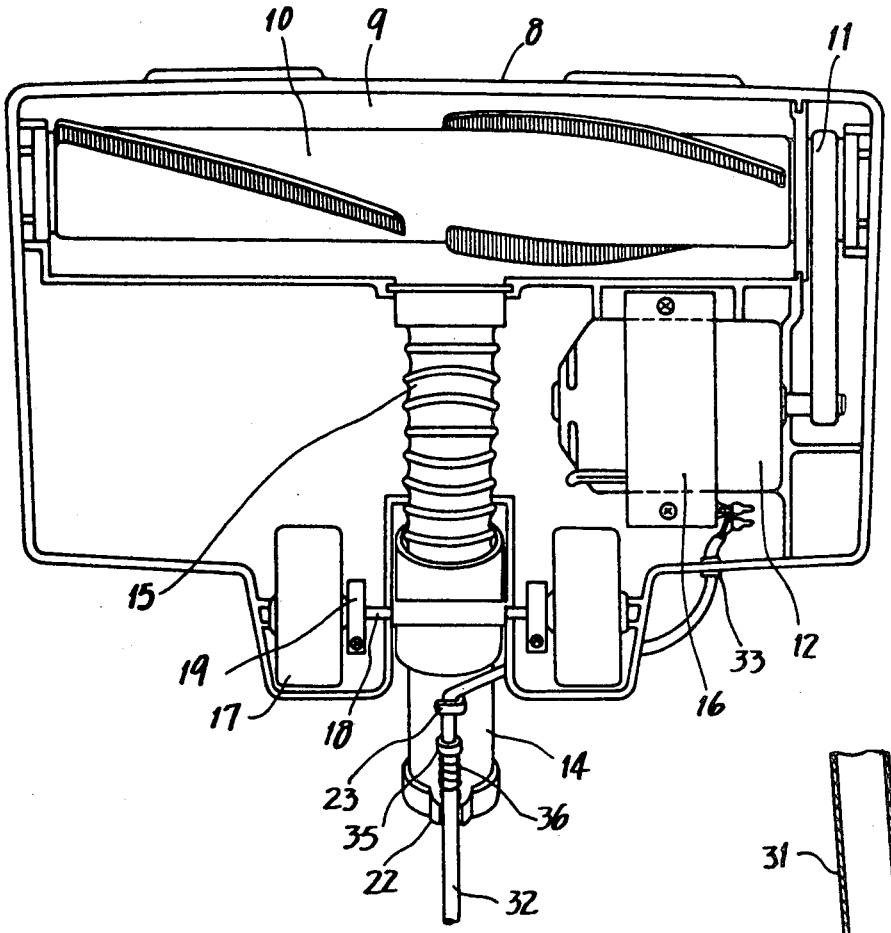
FIG. 2 is bottom view showing a nozzle with its bottom plate removed.
Figure 3:
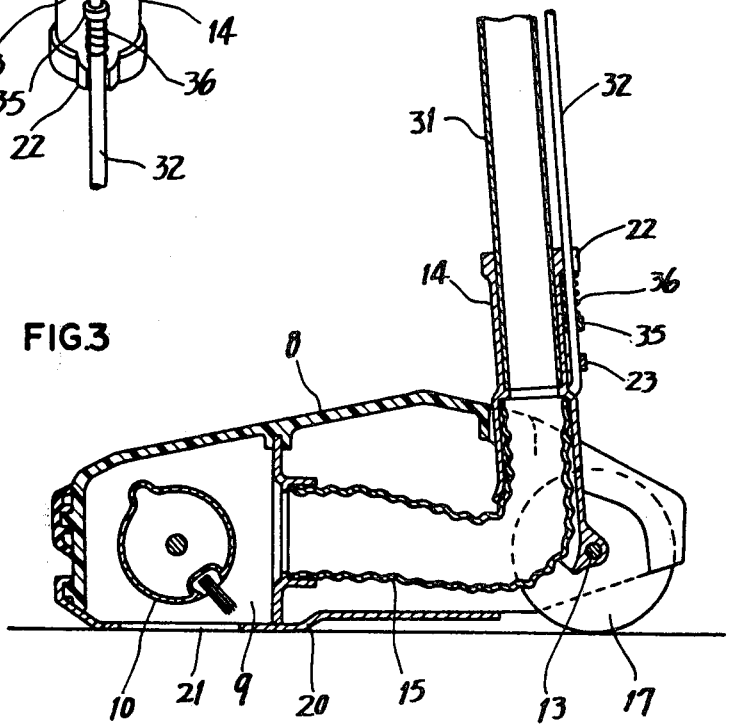
FIG. 3 is a view in section showing the nozzle.
Figure 4:
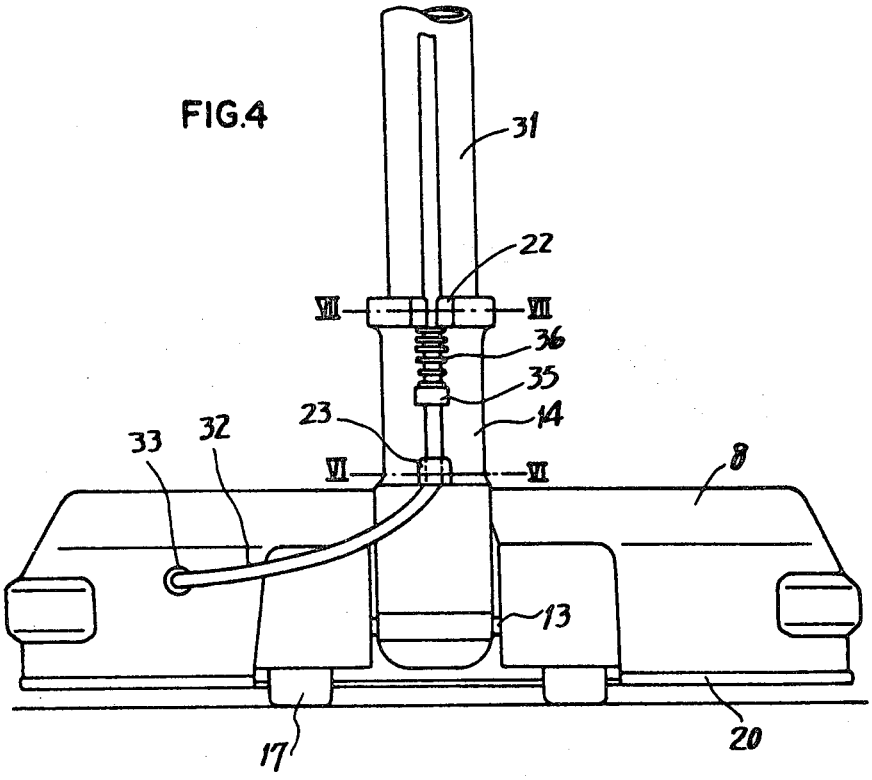
FIG. 4 is a rear view of the same.

As best illustrated in FIGS. 2 and 3, a nozzle 8 has a rotatable brush 10 in a front brush chamber 9, a commutator motor 12 disposed to the rear of the brush chamber 9 on one side thereof for driving the brush 10 through a belt 11, and a connecting pipe 14 disposed at a rear portion and turnable on a horizontal pin 13. A flexible hose 15 has one end open to the brush chamber 9 and the other end connected to the pipe 14. A holder 16 is provided for the motor 12. A pair of wheels 17 for the nozzle 8 has an axle 18 mounted by bearings 19 on the nozzle 8. The nozzle 8 has a bottom plate 20 formed with an opening 21 for the brush chamber 9. C-shaped and L-shaped cord holders 22 and 23 are formed on rear portions of the connecting pipe 14 integrally therewith and spaced apart from each other axially of the pipe 14.

Returning to FIG. 1, a flexible hose 24 has one end coupled by a connector 25 to a pipe 26 bent at an obtuse angle and the other end connected to a pipe 27 detachably fittable into the suction opening 5 of the main body 1. The hose 24 has a lead wire embedded therein. The lead wire has one end connected to a socket 28 inplanted in the connector 25 (FIG. 8) and the other end connected to a cord 30 having a plug 29 at its forward end. The plug 29 is connected to the socket 6 on the front side of the main body 1. Extension pipes 31 are connected to the bent pipe 26 and the connecting pipe 14 respectively.

An electrical cord 32 extending from the motor 12 of the nozzle 8 is provided with a bush 33 on the portion thereof which passes through the wall of the nozzle 8 and is made coextensive with the connecting pipe 14 on the rear side thereof by being fitted in the cord holders 22 and 23 as seen in FIGS. 1, 2, 4 and 5. The cord 32 further extends along the rear outer peripheral portions of the extension pipes 31 and the bent pipe 26 longitudinally thereof and is provided at its forward end with a plug 34 connected to the socket 28. The cord 32 electrically connects the nozzle 8 to the main body 1. Accordingly when the operation switch is closed by the switch pedal 2, the fan in the main body 1 is driven, while the motor 12 in the nozzle 8 drives the rotary brush 10. The cord 32 is tensioned by a spring 36 provided between the cord holder 22 and a flange 35 on the cord 32. Thus the cord 32 does not have any intermediate slack portion but is kept straight.

A cord cover 37 is provided on the rear side of the bent pipe 26 to cause the cord 32 to extend along the curve of the pipe 26. As best shown in FIGS. 8 to 11, the cord cover 37 is bent at an obtuse angle in its entirety like the bent pipe 26 and has a U-shaped cross section so as to cover the cord 32. The cord cover 37 is provided at its one end with a pair of opposed extensions having projections 39 fitting in a pair of cavities 38 formed in the outer wall of the connector 25, whereby the cord cover 37 is made turnable about the projections 39. The cord cover 37 is adapted to cover the cord 32 over the portion thereof coextensive with the bent pipe 26 and also the junction between the plug 34 and the socket 28.

A pair of pawls 40 projecting from the other end of the cord cover 37 are elastically fittable to opposite sides of the bent pipe 26. Each pawl 40 is provided at its free end with a protrusion 41 detachably engageable in a cavity 42 formed in the bent pipe 26. The pawls 40 thus designed hold the cord cover 37 fitted to the bent pipe 26. The cord cover 37 has a knob 43 for handling the cover and stoppers 44 bearing against the rear end of the plug 34 for preventing the plug 34 from inadvertently slipping off the socket 28 under the action of the spring 36.

With the cleaner described above, the rotary brush 10 driven by the motor 12 releases the dust deposited, for example, on a carpet by beating and scrape up the dust. The air carrying the dust is caused by the suction of the fan in the main body 1 to flow through the path of: the brush chamber 9 → hose 15 → connecting pipe 14 → extension pipes 31 → bent pipe 26 → flexible hose 24 → pipe 27 → suction opening 5. The air is then led into the dust collector bag within the main body 1, and the dust alone is captured therein.

The cord 32 is held tensioned by the spring 36 free of any slack during the cleaning operation and can of course be maintained under tension even when the connecting pipe 14 is tilted or raised. Additionally since the cord 32 and the junction between the plug 34 and the socket 28 on the bent pipe 26 are covered with the cord cover 37, the cord 32 will not be caught by furniture or like article, nor will the plug 34 slip off inadvertently.

Figure 8:
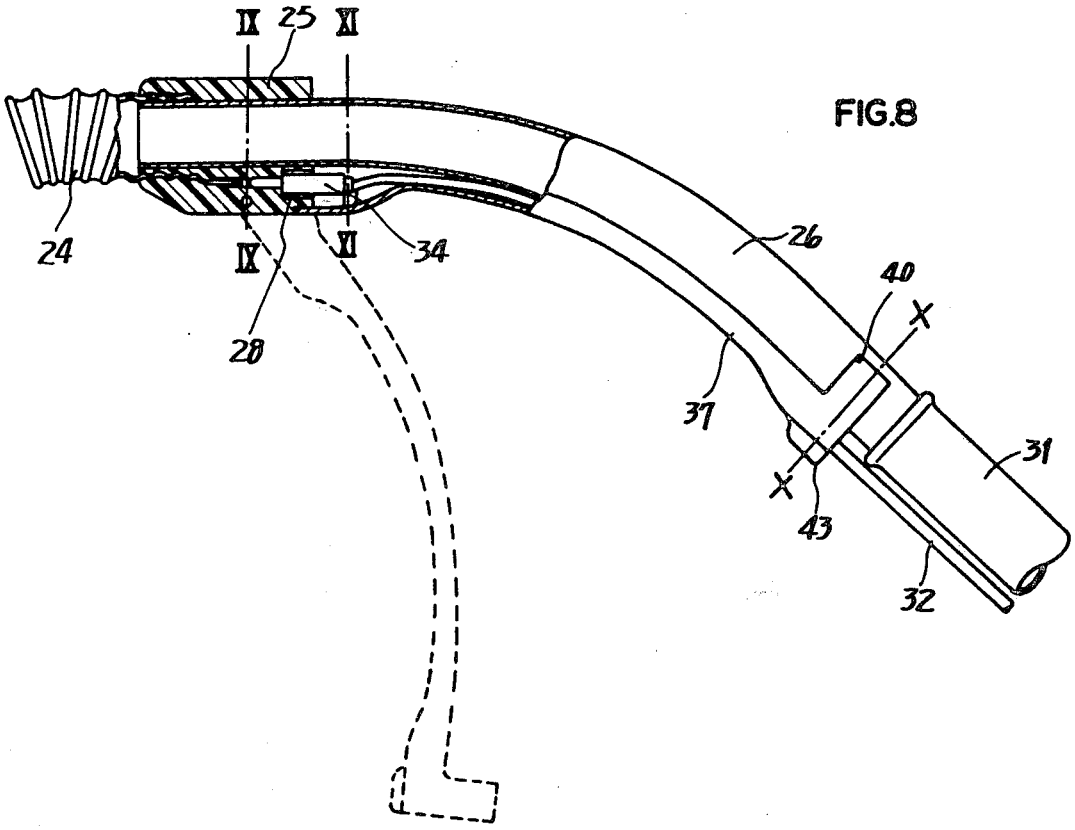
FIG. 8 is a view partly in section and showing a bent pipe and a cord cover.
Figure 5:
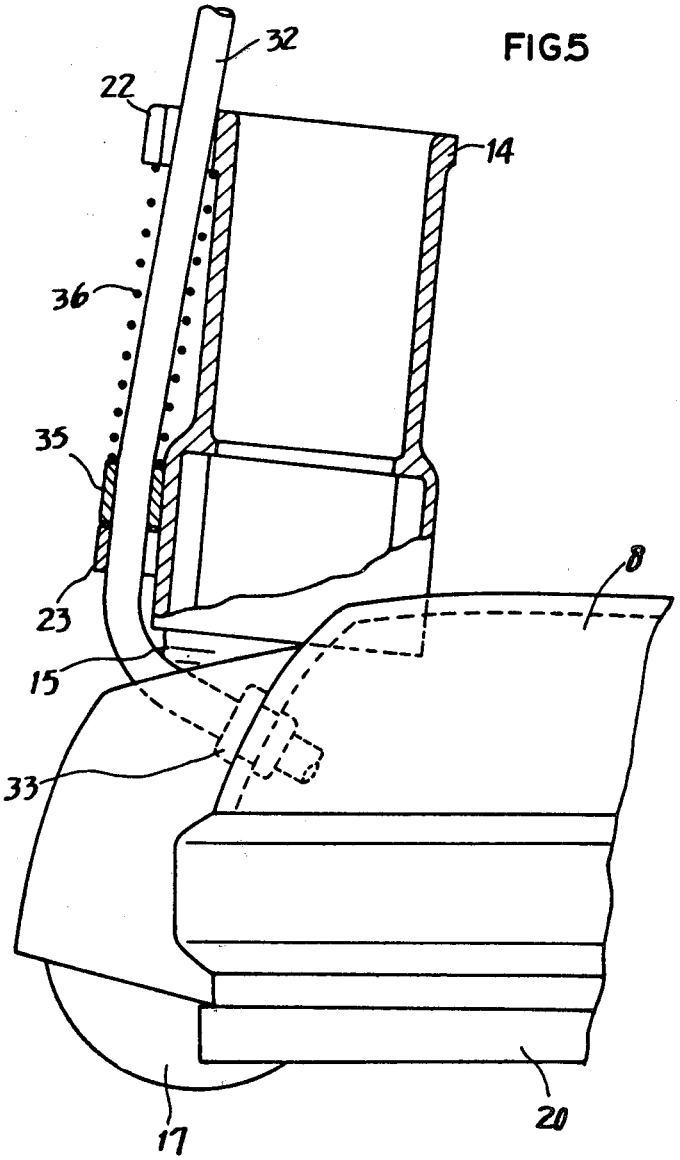
FIG. 5 is a fragmentary view partly in section of the nozzle to show an electrical cord as led out from the nozzle.
Figure 7:
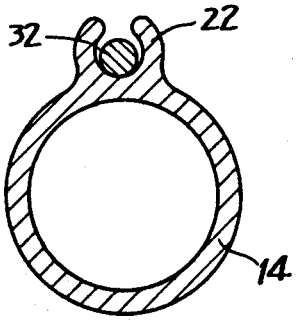
FIG. 7 is a view in section taken along the line VII—VII in FIG. 4.
Figure 6:
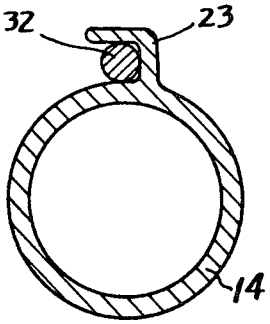
FIG. 6 is a view in section taken along the line VI—VI in FIG. 4.

When the protrusions 41 on the pawls 40 are disengaged from the cavities 42 in the bent pipe 26 and the cord cover 37 is turned to the dotted-line position in FIG. 8 with the knob 43 held with the hand, the plug 34 is detachable from the socket 28. Further with the other plug 29 detached from the mating socket 6, the main body 1 can be separated from the flexible hose 24, extension pipes 31 and nozzle 8. This is advantageous in that the vacuum cleaner can be compacted for packaging, or for storage while not in use.

Figure 12:
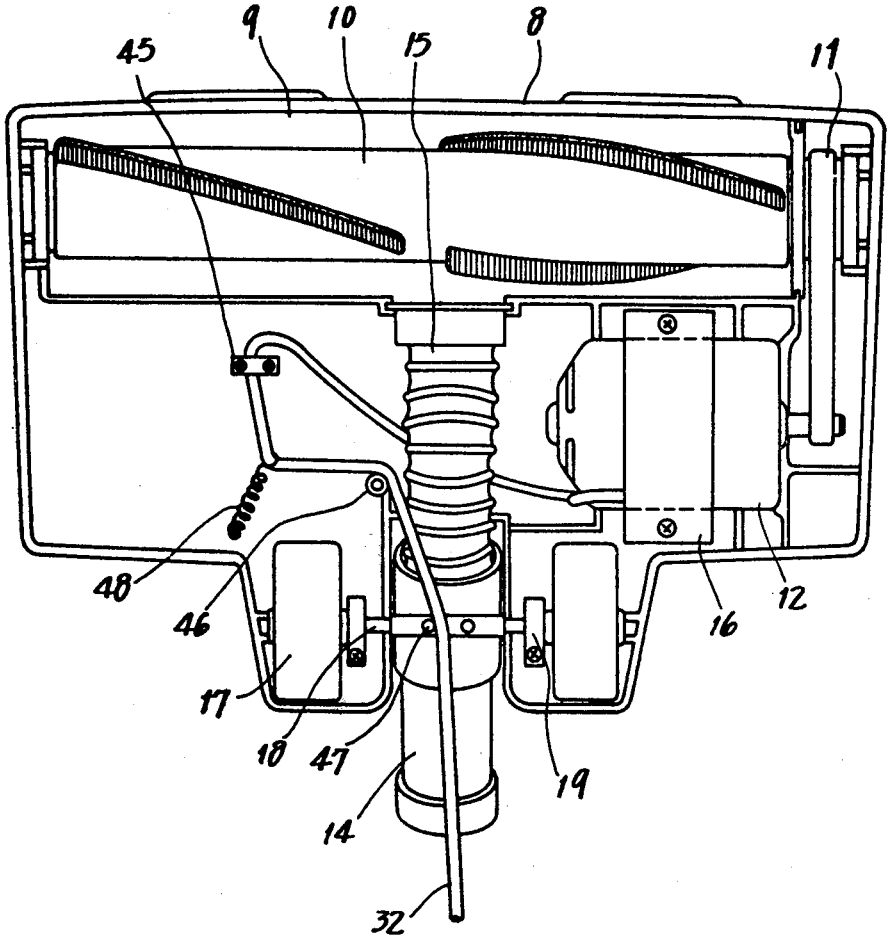
FIG. 12 is a bottom view showing another embodiment of the nozzle with its bottom plate removed.
Figure 13:
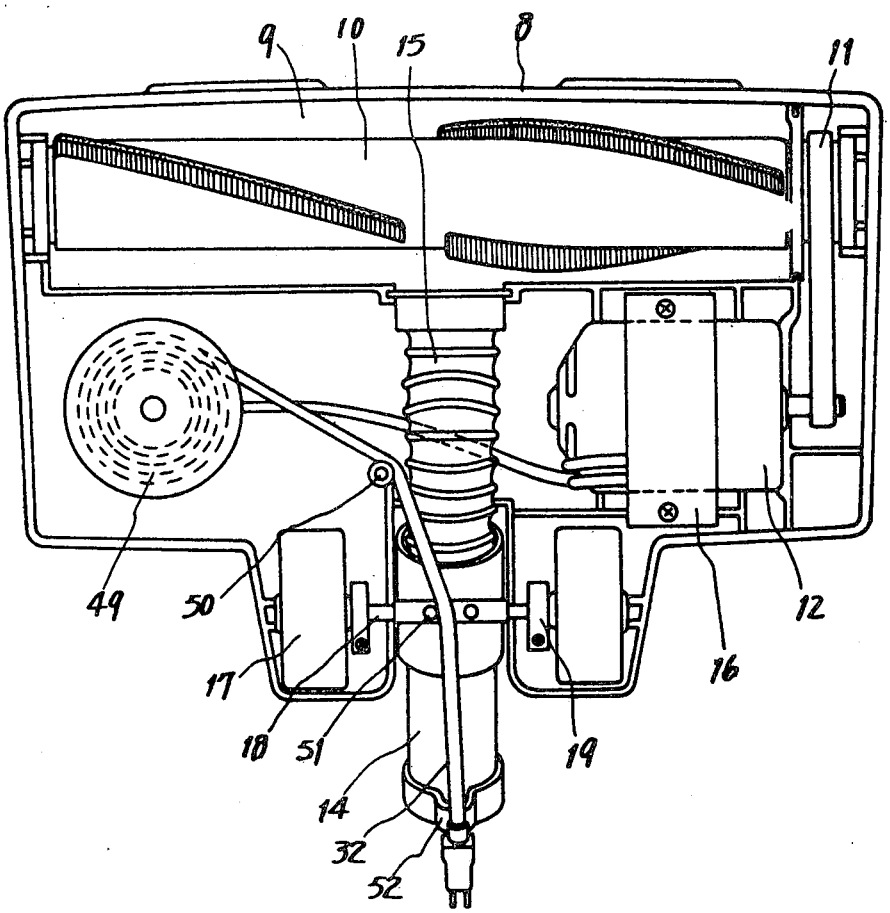
FIG. 13 is a bottom view showing still another embodiment of the nozzle with its bottom plate removed.

FIGS. 12 and 13 show other embodiments for tensioning the cord 32. With reference to FIG. 12, the cord 32 extending from the motor 12 is retained by cord holders 45, 46 and 47 and led out of the nozzle 8. The portion of the cord 32 between the pair of holders 45 and 46 is held pulled in a direction away from a phantom line through the holders 45 and 46 by a spring 48.

Further with reference to FIG. 13, a cord reel 49 is disposed within the nozzle 8, such that the force of an unillustrated spring for biasing the reel 49 in the take-up direction tensions the cord 32. Indicated at 50, 51 and 52 are cord holders.

The embodiments shown in FIGS. 12 and 13, although adapted to function basically in the same manner as the first embodiment, are more advantageous in that the cord 32 remains free of any slack whatever even when the connecting pipe 14 is tilted or raised.

Thus the vacuum cleaner of this invention assures a smooth cleaning operation.

What is claimed is:

1. A vacuum cleaner comprising a cleaner main body incorporating an electric fan and a dust collector; a nozzle having a rotary brush rotatable by an electric motor and a connecting pipe turnable about a horizontal axis; means for holding the connecting pipe in communication with a suction opening of the main body, the communication means including an extension pipe connected at its one end to the connecting pipe, a flexible hose having a lead wire embedded therein and communicating at its one end with the suction opening, and a bent pipe interconnecting the extension pipe and the flexible hose; a first electrical connector electrically connecting one end of the lead wire to the main body; an electrical cord extending from the nozzle and electrically connected to the other end of the lead wire by a second electrical connector to supply current to the electric motor; a cord cover attached to the bent pipe for rendering the cord coextensive with the bent pipe along the outer surface thereof and covering the second electrical connector; and biasing means mounted on the nozzle for tensioning the cord extending along the outer surface of the extension pipe.

2. A vacuum cleaner as defined in claim 1 wherein said biasing means comprises a cord holder formed on the outer periphery of the connecting pipe, and a spring provided between the holder and a flange formed on the cord.

3. A vacuum cleaner as defined in claim 1 wherein the cord cover has one end turnably supported on the bent pipe and the other end provided with a pair of pawls engageable in the outer peripheral surface of the bent pipe.

4. A vacuum cleaner as defined in claim 3 wherein the cord cover has a knob for turning the cover.

5. A vacuum cleaner as defined in claim 1 or 3 wherein the cord cover is provided with a stopper for preventing the second electrical connector from disengagement under the tension acting on the cord.

6. A vacuum cleaner as defined in claim 1 wherein said biasing means comprises a plurality of cord holders provided within the nozzle, and a spring for pulling the portion of the cord between a pair of the holders in a direction away from a phantom line through the pair of holders.

7. A vacuum cleaner as defined in claim 1 wherein said biasing means comprises a reel for the cord provided within the nozzle to cause the take-up force of the cord reel to tension the cord.

* * * * *

UNITED STATES PATENT AND TRADEMARK OFFICE

CERTIFICATE OF CORRECTION

PATENT NO. : 4,204,297

DATED : May 27, 1980

INVENTOR(S) : RYUICHI YASUNAGA ET AL

It is certified that error appears in the above—identified patent and that said Letters Patent is hereby corrected as shown below:

Title page, insert the following after item [75] Inventors:

[73] Assignee: Matsushita Electric Industrial Co., Ltd.
Osaka, Japan

Signed and Sealed this

*Seventh* Day of *October 1980*

[SEAL]

*Attest:*

SIDNEY A. DIAMOND

*Attesting Officer*

*Commissioner of Patents and Trademarks*